US011329384B2

(12) United States Patent
Rojas et al.

(10) Patent No.: US 11,329,384 B2
(45) Date of Patent: May 10, 2022

(54) Z-AXIS MEANDERING PATCH ANTENNA AND FABRICATION THEREOF

(71) Applicant: Embry-Riddle Aeronautical University, Inc., Daytona Beach, FL (US)

(72) Inventors: Eduardo Antonio Rojas, Port Orange, FL (US); Carlos R. Mejias-Morillo, Daytona Beach, FL (US)

(73) Assignee: Embry-Riddle Aeronautical University, Inc., Daytona Beach, FL (US)

( * ) Notice: Subject to any disclaimer, the term of this patent is extended or adjusted under 35 U.S.C. 154(b) by 0 days.

(21) Appl. No.: 17/154,706

(22) Filed: Jan. 21, 2021

(65) Prior Publication Data

US 2021/0226336 A1 Jul. 22, 2021

Related U.S. Application Data

(60) Provisional application No. 62/963,927, filed on Jan. 21, 2020.

(51) Int. Cl.
*H01Q 9/04* (2006.01)

(52) U.S. Cl.
CPC ..... *H01Q 9/0471* (2013.01); *H01Q 9/0464* (2013.01)

(58) Field of Classification Search
CPC ..... H01Q 9/0471
See application file for complete search history.

(56) References Cited

U.S. PATENT DOCUMENTS

| | | | | |
|---|---|---|---|---|
| 8,922,452 | B1 * | 12/2014 | O'Brien | H01Q 9/27 343/895 |
| 9,337,533 | B2 * | 5/2016 | Grandfield | H01Q 9/27 |
| 9,742,069 | B1 | 8/2017 | Hollenbeck et al. | |
| 10,063,108 | B1 | 8/2018 | Hosseini | |
| 10,396,469 | B1 * | 8/2019 | Fritz | H05K 3/108 |
| 10,903,556 | B2 * | 1/2021 | Lam | H01Q 5/328 |
| 2013/0194159 | A1 | 8/2013 | Alexopoulos et al. | |

(Continued)

OTHER PUBLICATIONS

Dias, G., et al., "3D Antenna for Wireless Power Transmission: Aperture Coupled Microstrip Antenna with Dielectric Lens", 2017 International Applied Computational Electromagnetics Society Symposium—Italy (ACES), (Mar. 2017), 1-2.

(Continued)

*Primary Examiner* — Ab Salam Alkassim, Jr.
(74) *Attorney, Agent, or Firm* — Schwegman Lundberg & Woessner, P.A.

(57) ABSTRACT

Apparatus and techniques described herein can include antenna configurations and related fabrication. For example, a Z-axis meandering antenna configuration can be fabricated, such as by forming a dielectric substrate extending in two dimensions and defining an undulating region extending out of a plane defined by the two dimensions; and forming at least one conductive region following a contour of the dielectric substrate including at least a portion of the undulating region. The at least one conductive region can follow the contour of the dielectric substrate, such as including a first conductive region on a first layer, and a second conductive region on another layer separate from the first conductive region of the first conductive layer.

20 Claims, 7 Drawing Sheets

(56) References Cited

U.S. PATENT DOCUMENTS

| | | | | |
|---|---|---|---|---|
| 2013/0199916 | A1* | 8/2013 | Iwamoto | H01L 29/4908 977/734 |
| 2014/0118211 | A1 | 5/2014 | Cooper et al. | |
| 2015/0171520 | A1* | 6/2015 | Parsche | H01Q 9/0471 343/795 |
| 2016/0043464 | A1* | 2/2016 | Grandfield | H01Q 1/36 343/848 |
| 2017/0040105 | A1* | 2/2017 | Peralta | G06K 19/07783 |
| 2017/0324166 | A1* | 11/2017 | Wang | C01B 32/186 |
| 2018/0123251 | A1* | 5/2018 | Wang | H01Q 9/0471 |
| 2018/0138589 | A1* | 5/2018 | Clegg | H01Q 1/523 |

OTHER PUBLICATIONS

Franchina, V., et al., "A 3d lte antenna for vehicular applications", 2017 IEEE International Symposium on Antennas and Propagation USNC/URSI National Radio Science Meeting, (Jul. 2017), 637-638.

Ketterl, T. P., et al., "A 2.45 GHz Phased Array Antenna Unit Cell Fabricated Using 3-D Multi-Layer Direct Digital Manufacturing", IEEE Transactions on Microwave Theory and Techniques, 63(12), (Dec. 2015), 4382-4394.

Lee, S., et al., "Corrugated circular microstrip patch antennas for miniaturisation", Electronics Letters, vol. 38, No. 6, (Mar. 2002), 262-263.

Mejias-Morillo, C. R., et al., "Z-Meandering Miniaturized Patch Antenna Using Additive Manufacturing", 2020 IEEE Radio and Wireless Symposium (RWS), Jan. 26-29, 2020, San Antonio, TX, (2020), 31-34.

Mufti, S., et al., "3d electrically small dome antenna", 2014 Loughborough Antennas and Propagation Conference (LAPC), (Nov. 2014), 653-656.

Ramirez, R. A., et al., "3D Tag with Improved Read Range for UHF RFID Applications using Additive Manufacturing", 2015 IEEE 16th Annual Wireless and Microwave Technology Conference (WAMICON), (2015), 1-4.

Rojas-Nastrucci, E. A., et al., "Metallic 3D Printed Ka-Band Pyramidal Horn using Binder Jetting", 2016 IEEE MTT-S Latin America Microwave Conference (LAMC), (Dec. 2016), 1-3.

Sravani, P., et al., "Design and analysis of 3d posts based antenna", 2015 International Symposium on Antennas and Propagation (ISAP), (Nov. 2015), 1-4.

Sravani, P., "Design of 3D antennas for 24 GHz ISM band applications", 2015 28th International Conference on VLSI Design, (Jan. 2015), 470-474.

"3D Printing Market Size Share—Industry Trends and Growth by 2027", (c) 2020 Allied Market Research, (2020), 8 pgs.

"Antenna Technologies for IoT Applications: Industry Size, Share, Outlook, Company Profile Details Report", AB Newswire (c) 2012-2020, (Dec. 28, 2020), 4 pgs.

"Global Smart Antenna Market Will Reach to USD 8.9 Billion by 2025: Zion Market Research", (Sep. 13, 2019), 5 pgs.

"Nano Dimension Blog—Shaping the future of additive manufacturing and 3D printed electronics", (c) 2020 Nano Dimension, (2020), 13 pgs.

Jackson, Beau, "A closer look at the developing electronics 3D printing industry", [online]. [retrieved on Dec. 28, 2020]. Retrieved from the Internet: <URL: https://3dprintingindustry.com/news/a-closer-look-at-the-developing-electronics-3d-printing-industry-142452/>, (Oct. 31, 2018), 20 pgs.

O'Brien, Jonathan M., et al., "Miniaturization of a Spiral Antenna Using Periodic Z-Plane Meandering", IEEE Transactions on Antennas and Propagation, vol. 63, No. 4, (Apr. 2015), 1843-1848.

O'Brien, Jonathan, et al., "Miniaturization of Microwave Components and Antennas Using 3D Manufacturing", (2015), 4 pgs.

Yu, Xiaoju, et al., "3-D Printed Parts for a Multilayer Phased Array Antenna System", IEEE Antennas and Wireless Propagation Letters, vol. 17, No. 11, (Nov. 2018), 2150-2154.

* cited by examiner

Z-AXIS MEANDERING PATCH ANTENNA AND FABRICATION THEREOF

CLAIM OF PRIORITY

This patent application claims the benefit of priority of Eduardo Antonio Rojas et al., U.S. Provisional Patent Application Ser. No. 62/963,927, titled "Z-AXIS MEANDERING PATCH ANTENNA AND FABRICATION THEREOF," filed on Jan. 21, 2020, which is hereby incorporated by reference herein in its entirety.

FIELD OF THE DISCLOSURE

This document pertains generally, but not by way of limitation, to patch antennas and related fabrication techniques, and more particularly to a meandering patch antenna, such as for operation in radio-frequency (RF) or microwave ranges of frequencies.

BACKGROUND

Planar antennas can include patch structures comprising a conductive region and a dielectric material. Such planar antennas can be fabricated as a portion of a printed circuit assembly for use on or within a device such as a mobile or portable device, or in other applications such as vehicular or aerospace applications. Generally, one or more resonant frequencies can be established for such a planar antenna by various geometrical parameters defined by the antenna structure. For example, a circular patch antenna can include a planar, circular conductive region, such as formed upon a dielectric substrate. The circular conductive region can include a radius, and a resonant frequency of the circular patch antenna can be established in part by a value of the radius.

SUMMARY OF THE DISCLOSURE

The present inventors have recognized, among other things, that a planar antenna configuration, such as a circular patch antenna as mentioned above, may be difficult to miniaturize. For example, simply reducing a radius of the circular patch will generally increase a resonant frequency, which can be undesired. The present inventors have recognized, among other things, that a meandering antenna structure can be established, such as defining a conductive path extending in three dimensions (e.g. within and out of a two-dimensional plane). The present inventors have also recognized, among other things, that such a meandering structure can provide a lower resonant frequency than a purely planar structure, while providing the same mechanical footprint. In addition, or instead, a meandering structure can provide other benefits such as one or more of reduced weight, reduced footprint, improved radiation characteristics such as directivity or efficiency, or improved bandwidth, as illustrative examples.

Such a configuration can be referred to as a "Z-axis meandering" configuration or "Z-meandering" configuration. The present inventors have also recognized, among other things, that fabrication of a Z-meandering structure can present challenges. Generally, planar antennas fabricated using printed circuit board fabrication techniques include use of planar dielectric substrate materials, such as a glass-epoxy laminates or other planar materials (e.g., rigid materials in sheet form). By contrast, a Z-meandering configuration can include use of a substrate having an undulating (e.g., ribbed) pattern extending in an out-of-plane direction. Establishing such an undulating structure can present challenges, along with related challenges in establishing one or more conductive layers upon or within such a dielectric material.

To remedy such challenges, the present inventors have also recognized, among other things, that various deposition techniques can be used to form one or more of a dielectric layer or a conductive region. For example, a dielectric substrate can be formed using fused deposition of a polymer material (e.g., using an additive manufacturing approach such as a three-dimensional printing or "3D printing" approach). One or more conductive regions can be formed such as using a conductive ink deposited on a dielectric layer. In this manner, complex shapes extending in three dimensions can be formed in a repeatable manner, such as to facilitate rapid prototyping or production. Other fabrication techniques can be combined with techniques recited herein, such as including stamping or hot-forming of a dielectric or conductive material, as illustrative examples.

In an example, an antenna can include a dielectric substrate extending in two dimensions and defining an undulating region extending out of a plane defined by the two dimensions, and at least one conductive region following a contour of the dielectric substrate including at least a portion of the undulating region. The at least one conductive region can include a first conductive region on a first layer, and a second conductive region on another layer separate from the first conductive region of the first layer. For example, the dielectric substrate comprises a material deposited using fused deposition and the at least one conductive region comprises a cured conductive ink. In an example, a method for fabricating an antenna can include forming a dielectric substrate extending in two dimensions and defining an undulating region extending out of a plane defined by the two dimensions, and forming at least one conductive region following a contour of the dielectric substrate including at least a portion of the undulating region. For example, the at least one conductive region following the contour of the dielectric substrate can include a first conductive region on a first layer, and a second conductive region on another layer separate from the first conductive region of the first layer. In an example, the forming the dielectric substrate includes depositing a dielectric substrate material using fused deposition. In an example, the forming the dielectric substrate includes at least one of stamping or hot-forming the dielectric substrate. In an example, the forming the at least one conductive region comprises depositing a conductive ink. In an example, the forming the at least one conductive region comprises printing a conductive ink.

In an example, an antenna fabrication system can include an additive fabrication means (e.g., a three-dimensional printer such as providing fused deposition printing as an illustrative example) for forming a dielectric substrate, the dielectric substrate extending in two dimensions and defining an undulating region extending out of a plane defined by the two dimensions, and a printing means (e.g., an ink-jet or screen printing apparatus, as an illustrative example) for forming at least one conductive region following a contour of the dielectric substrate including at least a portion of the undulating region.

This summary is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Additive manufacturing, such as three-dimensional printing or other techniques, can provide one or more of a low-cost or fast-prototyping capability. Additive manufacturing techniques can be used for fabrication of portions of radio-frequency or microwave-frequency devices. Such fabrication techniques can facilitate creation of antennas or substrate structures, for example, having complex three-dimensional (3D) shapes. Such shapes can provide improvements in various antenna characteristics as compared to corresponding two-dimensional planar structures. Three-dimensional shapes can include domes, folded structures, dielectric lens structures, and dielectric posts, as illustrative examples.

Geometry-based miniaturization techniques can be applied to patch antennas, such as to provide corrugated or Z-axis (e.g., out-of-plane) meandering structures. For example, a reduction of 21.12 percent in an area of an antenna footprint can be achieved by corrugating a circular patch antenna tuned to 1.575 gigaHertz (GHz), in one approach. A Z-axis meandering approach can provide a miniaturization factor of 1.2, as another illustrative example. The illustrative examples in this document include a Z-meandering structure that can include a lateral profile that is sinusoidal (e.g., radially symmetric and providing sinusoidal profile in the out-of-plane axis). Such a Z-meandering configuration can provide miniaturization as compared to a planar circular patch antenna configuration. As an illustrative example, use of an undulated substrate can reduce a resonant frequency from about 5 GHz to about 4.6 GHz while maintaining an antenna gain close to 6 dBi, which represents a reduction of 8% of the footprint compared to a corresponding 4.6-GHz two-dimensional circular patch antenna. Full-wave electromagnetic simulations show that miniaturization can be controlled by a Z-meandering amplitude (e.g., a protrusion or height of undulating portions in the out-of-plane direction) and a count of undulation cycles per revolution about a central region.

Figure 1A:
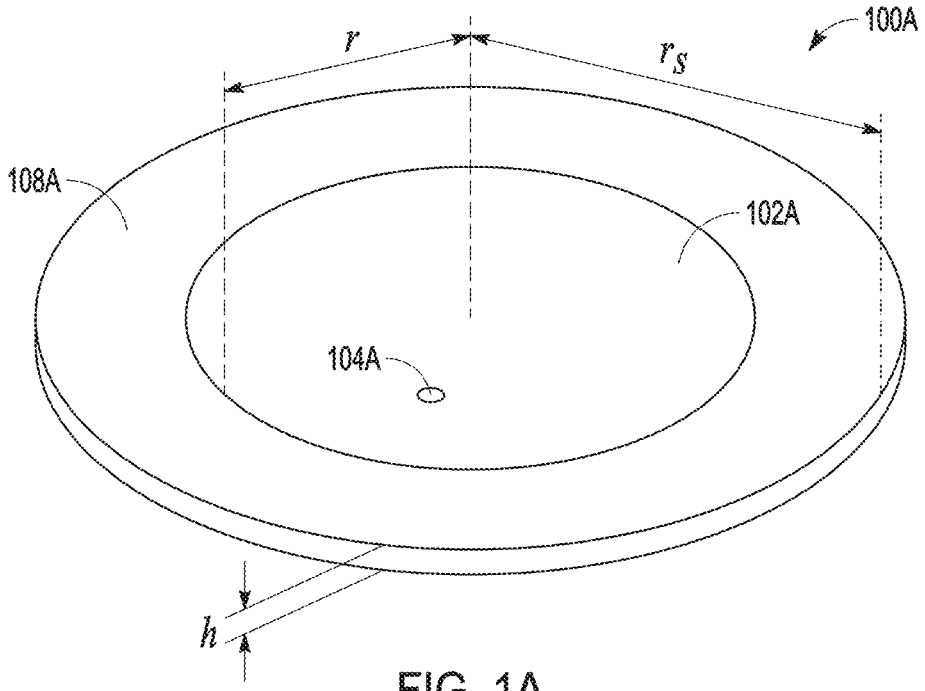
FIG. 1A illustrates generally a first example comprising a planar two-dimensional (2D) circular patch antenna.
Figure 1B:
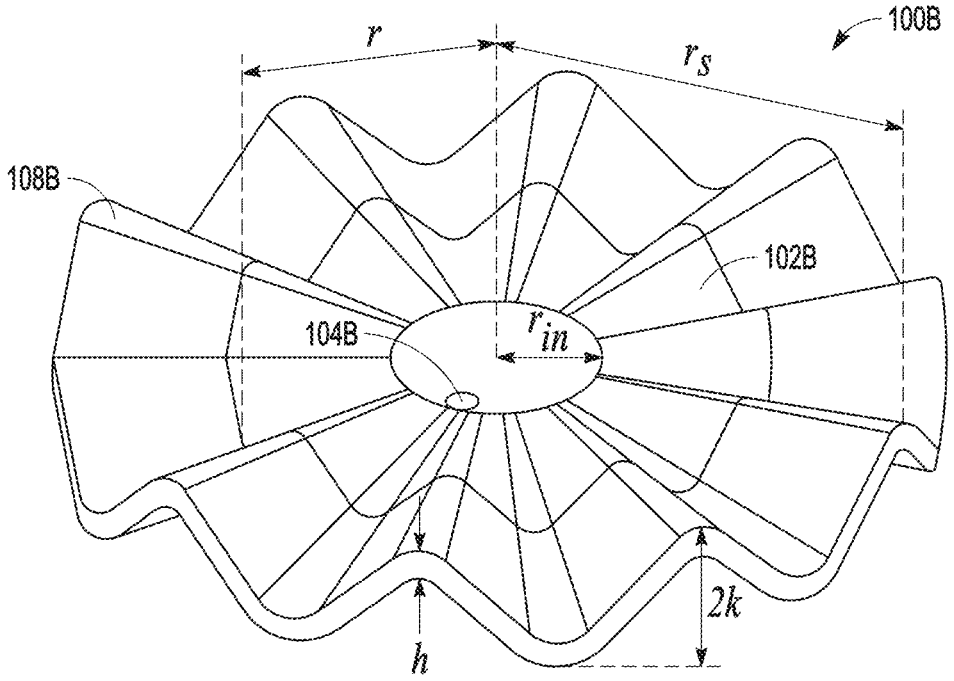
FIG. 1B illustrates generally a second example comprising an undulating (e.g. "Z-meandered") antenna configuration.
Figure 2A:
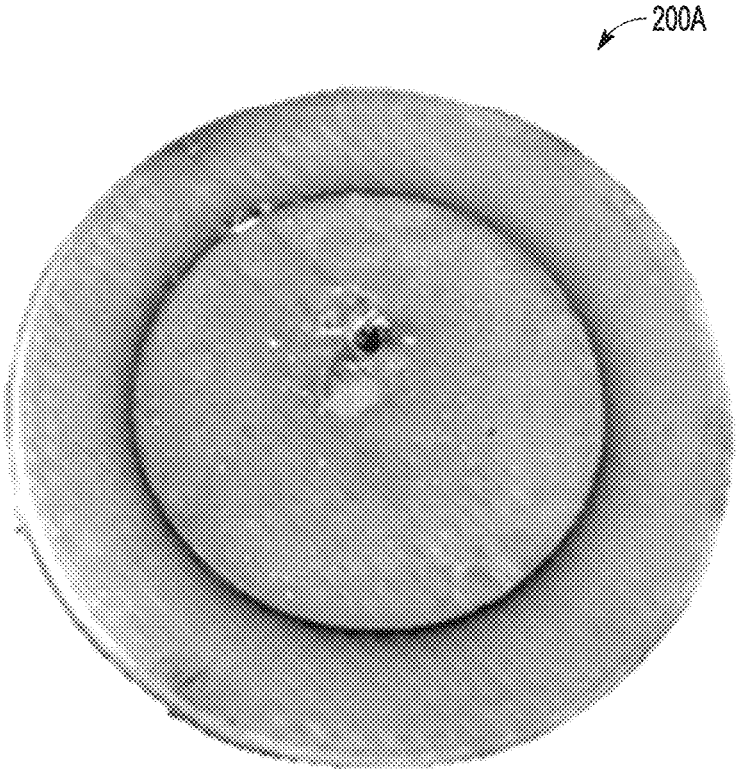
FIG. 2A illustrates generally an example comprising a planar (2D) circular patch antenna fabricated using an additive manufacturing approach.
Figure 2B:
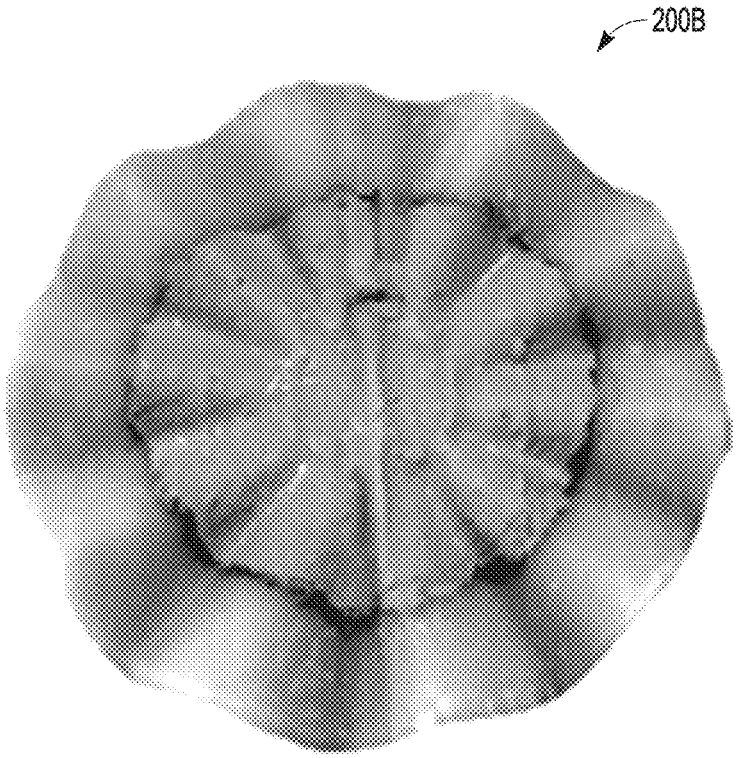
FIG. 2B illustrates generally an example comprising an undulating antenna configuration fabricating using an additive manufacturing approach.

In an illustrative example, a sinusoidal undulated circular patch antenna can be fed at a feed location (e.g., "feed point") such as by a coaxial connector placed about 4 millimeters (mm) from a central region of the patch, as shown generally in the examples of FIG. 1B and FIG. 2B. A two-dimensional circular patch antenna is shown in FIG. 1A and as fabricated in FIG. 2A, to provide a basis of comparison with the examples of FIG. 2A and FIG. 2B.

FIG. 1A illustrates generally a first example comprising a planar two-dimensional (2D) circular patch antenna 100A, such as including a substrate 108A (e.g., a dielectric substrate), a first conductive region 102A, a feed location 104A, and optionally a second conductive region (e.g., a ground plane or reference plane) on another surface of the substrate 108A, such as covering a portion or an entirety of a surface of the substrate 108A. FIG. 1B illustrates generally a second example comprising an undulating (e.g. "Z-meandered") antenna configuration 100B. The second example 100B can include a substrate 108B, a feed location 104B, a first conductive region 102B, and optionally, a second conductive region on another surface of the substrate 108B, such as covering a portion or an entirety of a surface of the substrate 108B. In FIG. 1A and FIG. 1B, the substrate 108A or 108B can define a radius, $r_s$, and the first conductive region 102A or 102B can define a radius, r, and a substrate 108A or 108B thickness, h.

In the second example 100B of FIG. 1B, a Z-oscillation amplitude, k, can define a range of out-of-plane protrusion as shown, and the first conductive region 102B can include a central region radius, $r_{in}$. Generally, the examples in this document can be fabricated using a 3D-printed acrylonitrile butadiene styrene (ABS) dielectric or other polymer, such as to provide the substrate 108A or 108B, or a layer of such a substrate if a multi-layer structure is used having multiple dielectric layers. Conductive regions such as the first conductive regions 102A or 102B, can be formed on either the top or bottom of a dielectric layer, or both, such as using a printed conductive ink. Generally, in the examples herein, a first conductive region can provide a patch such as a circular patch (e.g., first conductive region 108A of FIG. 1A) or Z-meandering patch (e.g., first conductive region 108B of FIG. 1B). A second conductive region can be formed, such as located on a surface or layer of the substrate opposite the first conductive region. For example, in the examples herein, a second conductive region can include a ground or return plane located on a bottom surface of the dielectric substrate and extending from the center to the edge of the dielectric substrate.

Examples of such 3D-printed ABS dielectric and printed conductive layers are shown in the illustrative examples of FIG. 2A, which illustrates generally an example comprising a planar (2D) circular patch antenna fabricated using an additive manufacturing approach, and FIG. 2B, which illustrates generally an example comprising an undulating antenna configuration fabricating using an additive manufacturing approach. The examples of FIG. 1A, FIG. 1B, FIG. 2A, and FIG. 2B were fabricated and simulated. Values of the dimensions for such illustrative fabricated examples are shown below in TABLE 1 (except where such values are varied to illustrate different performance parameters), where the values annotated for "Circular Path Antenna (2D)" correspond to the first example 100A and 200A of FIG. 1A and FIG. 2A, and the values annotated for "Z-Meandering (Undulated) Patch Antenna)" correspond to the second example 100B and 200B of FIG. 2B and FIG. 2B. Such dimensional values are illustrative but non-limiting.

TABLE 1

Antenna dimensions, where a relative permittivity of the ABS material was assumed to be 2.8 in these illustrative examples.

| Circular Patch Antenna (2D) | | | | | |
|---|---|---|---|---|---|
| r (mm) | h (mm) | $r_s$ (mm) | | | |
| 10.15 | 1 | 16.15 | | | |
| Z-Meandering (Undulated) Patch Antenna | | | | | |
| r (mm) | h (mm) | $r_s$ (mm) | $r_{in}$ (mm) | k (mm) | n |
| 10.15 | 1 | 16.15 | 3.5 | 2.5 | 10 |

The examples 200A and 200B of FIG. 2A and FIG. 2B were fabricated using a Hyrel 3D Engine SR printer (available from Hyrel L.L.C., Norcross, Ga., USA) with an 0.5-mm extrusion nozzle and a bed, heated to 240 C and 75 C, respectively. An ABS layer thickness was set to 200 micrometers. The geometry of the examples herein includes overhang angles beyond 45 degrees, and fabrication was performed by fabricating two substrate halves oriented vertically, then adhering the halves together using an acetone spray. Conductive layers in the examples herein were fabricated using Dupont CB028 silver flake ink (e.g., a silver-bearing ink having a carrier, the silver-bearing ink available from Dupont de Nemours, Inc., Wilmington, Del., USA), and such layers were screen printed using a 1-mil Kapton tape as a screen. The screen was patterned with a laser using an LPKF Protolaser U4 (available from LPKF Laser & Electronics North America, Tualatin, Oreg., USA). The ink was cured at 80 C for each side after deposition. Other printing techniques and material systems can be used, such as, for example, ink-jet printing or thermal printing.

The configurations shown in FIG. 1A and FIG. 1B were simulated using High Frequency Structure Simulator (HFSS) in the ANSYS Electronic Desktop, version 2017.2.0 (available from Ansys, Inc., Canonsburg, Pa., USA). As an illustrative example, antenna configurations can be generated by the simulation tool using an equation-based input expression having parameters including specifying a dielectric radius, $r_s$, a conductive region radius, r, and a dielectric substrate thickness, h, for the first example 100A, and a dielectric radius, $r_s$, a conductive region radius, r, a Z-oscillation amplitude, k, a dielectric substrate thickness, h, and a central region radius, $r_{in}$, and a count of cycles per revolution, n, for the second example 100B (e.g., the Z-meandering configuration).

Figure 3:
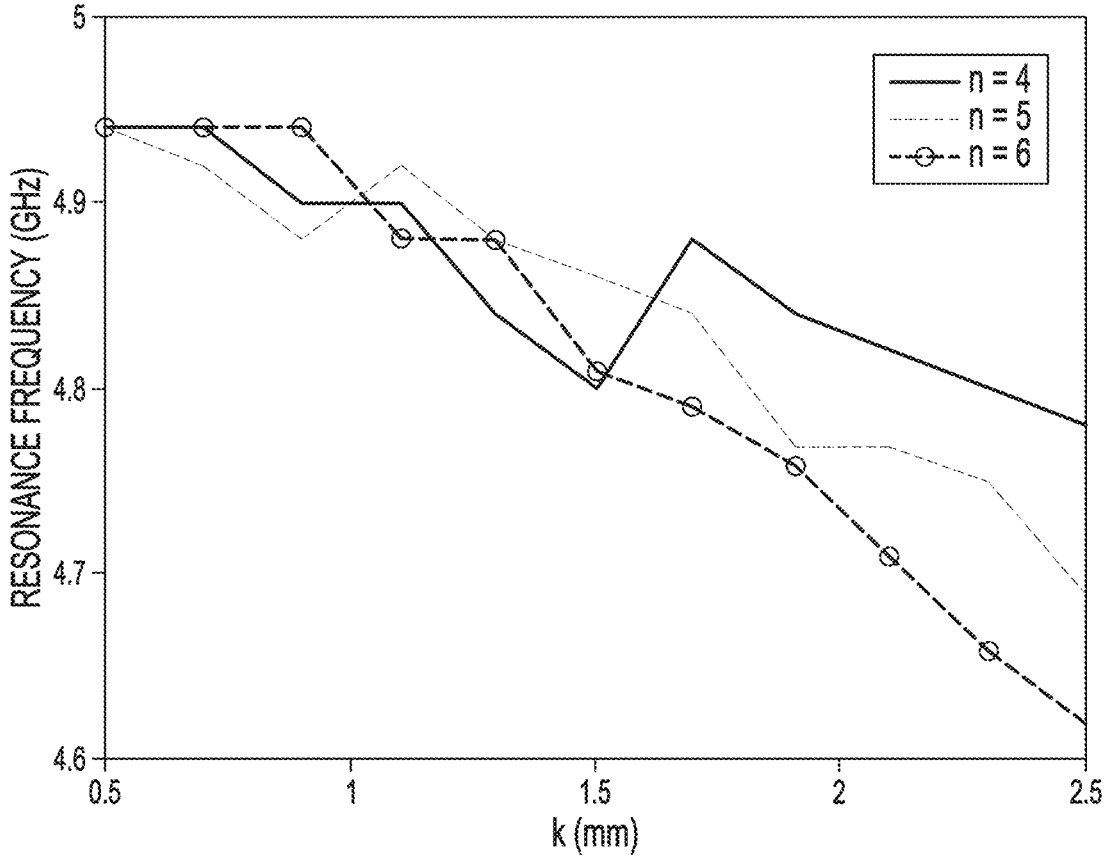
FIG. 3 shows illustrative examples of plots comprising simulated resonant frequencies as a function of a Z-axis meandering "amplitude" (e.g., a spatial thickness range) ranging from 0.5 millimeters (mm) to 2.5 mm and a count of cycles per revolution ranging from four to six, with the other geometric parameters held constant.

For example, FIG. 3 shows illustrative examples of plots comprising simulated resonant frequencies as a function of a Z-axis meandering "amplitude" (e.g., a spatial thickness, "k" range) ranging from 0.5 millimeters (mm) to 2.5 mm and a count of cycles per revolution ranging from four to six, with the other geometric parameters held constant. FIG. 3 illustrates generally that as the Z-oscillation amplitude increases, a resulting resonant frequency is reduced. FIG. 3 also illustrates generally that a rate of change of resonant frequency is non-linear and increases as a count of cycles increases.

Figure 4:
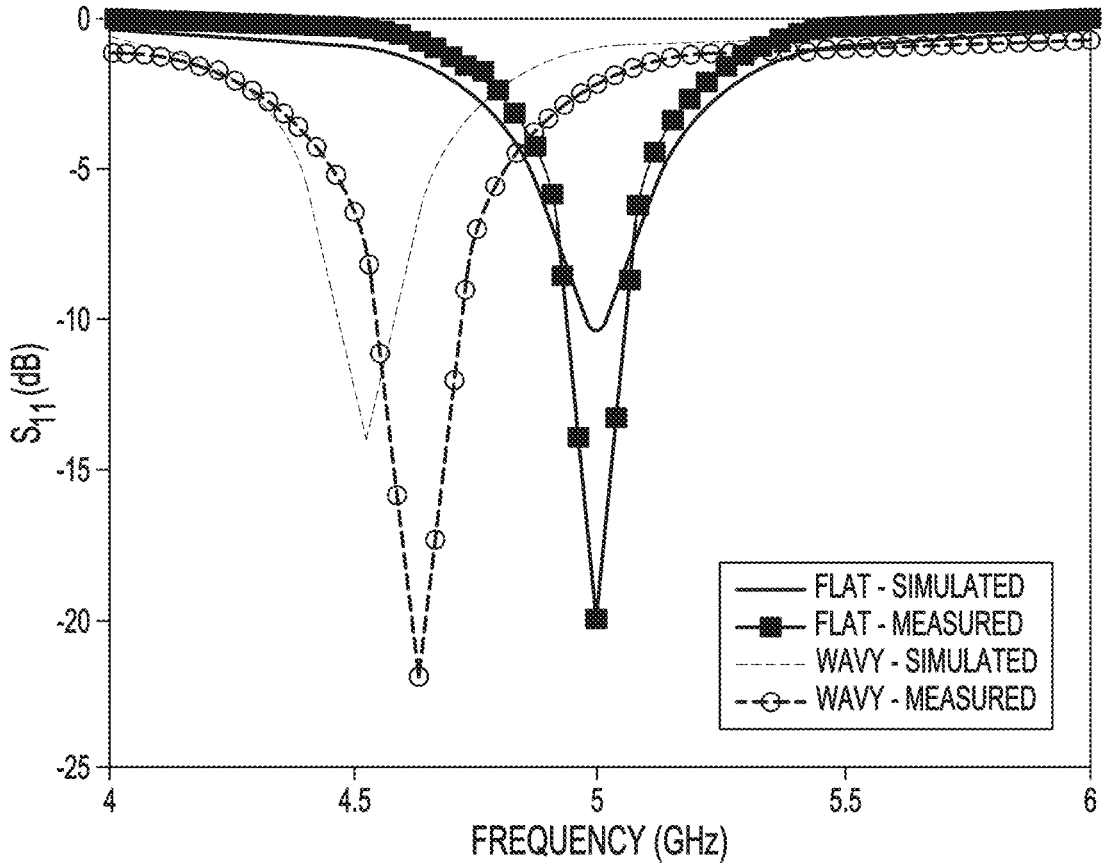
FIG. 4 shows illustrative examples of plots comprising measured and simulated S11 parameter values of a 2D circular patch antenna (e.g., "flat" configuration as annotated in FIG. 4) and a Z-meandered antenna configuration (e.g., "wavy" as annotated in FIG. 4).

FIG. 4 shows illustrative examples of plots comprising measured and simulated $S_{11}$ parameter values of a 2D circular patch antenna (e.g., "flat" configuration as annotated in FIG. 4) and a Z-meandered antenna configuration (e.g., "wavy" as annotated in FIG. 4). A Keysight E5071C ENA Vector Network Analyzer calibrated with a Keysight N4433A ECal module (available from Keysight Technologies, Santa Rosa, Calif., USA) was used to measure the $S_{11}$ parameter (corresponding to reflection coefficient or mismatch) of the antenna configurations shown in FIG. 2A and FIG. 2B, using a frequency range from 4 GHz to 6 GHz.

As shown in FIG. 4, measurements of the circular patch and the meandered antenna configurations agree relatively closely with the predicted resonant frequencies established via simulation (e.g., at locations where the $S_{11}$ parameter dips, indicating less reflected power at the input port). The measurements above illustrate 148.2 MHz and 109 MHz of 10-dB return loss bandwidth for the 3D-meandered antenna and the 2D circular patch antenna, respectively. This difference in bandwidth represents an increase of 36 percent for the 3D Z-meandered configuration as compared to the 2D circular patch structure. Without being bound by theory, the increment in the bandwidth is believed due Z-meandered antenna occupying a greater volumetric space of the radian sphere as compared to the 2D planar patch.

Figure 5A:
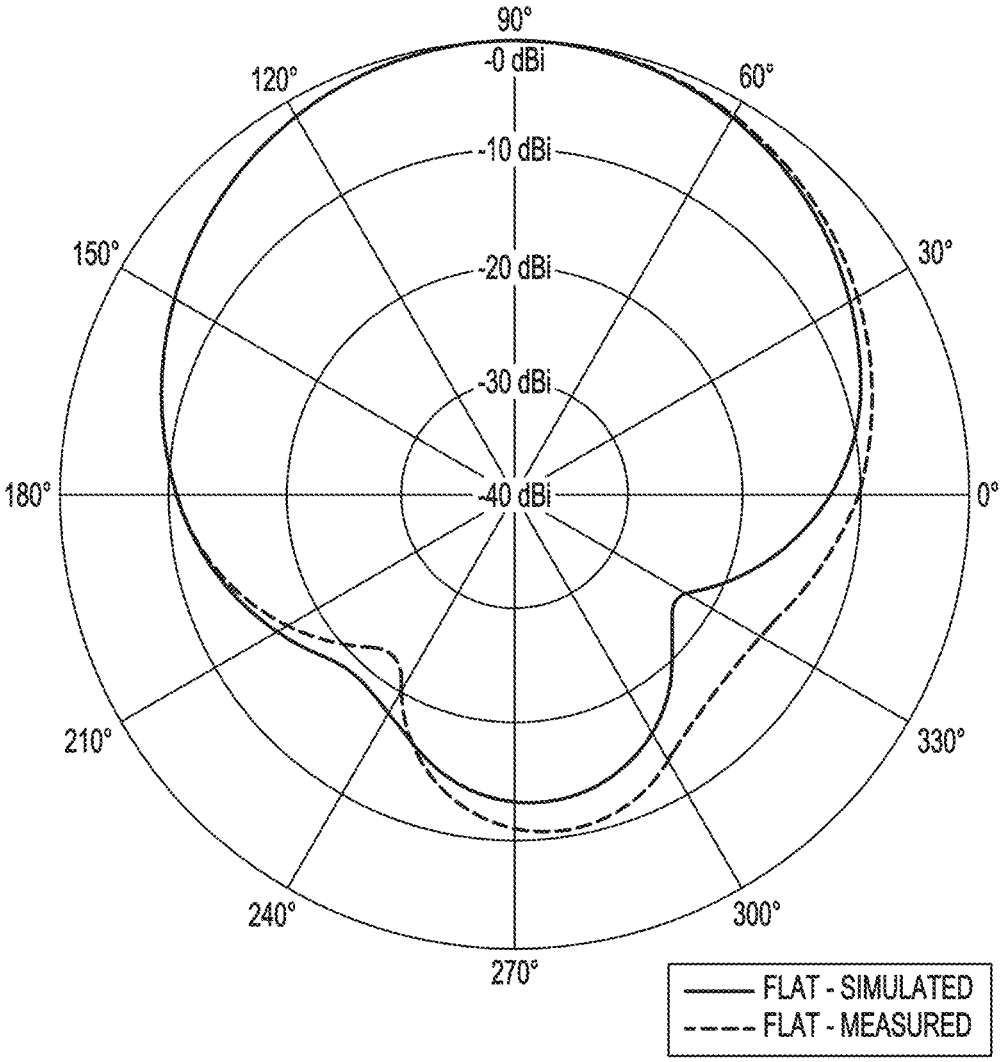
FIG. 5A shows illustrative examples of plots comprising simulated and measured H-Plane (e.g., elevational) radiation patterns for a 5 gigahertz (GHz) 2D circular patch antenna, in units of decibels relative to an isotropic radiator (dBi).
Figure 5B:
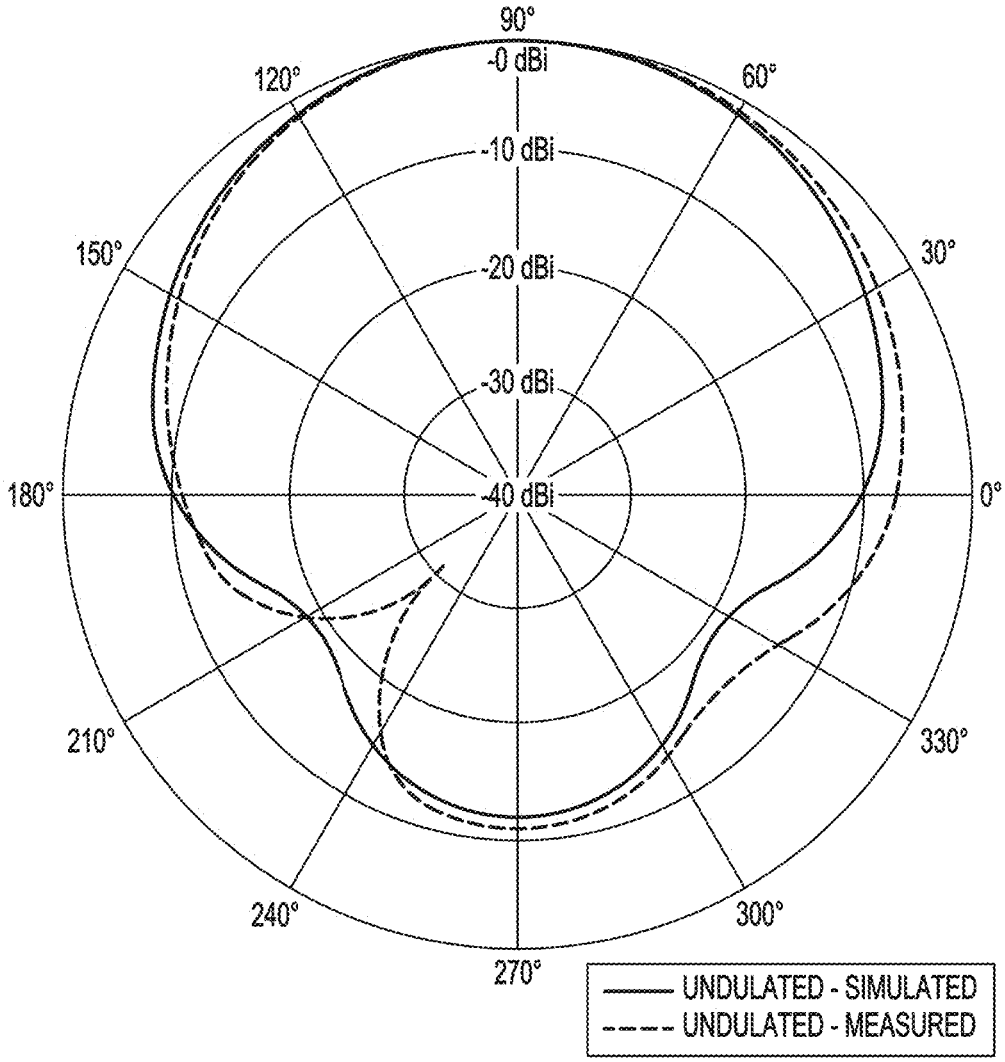
FIG. 5B shows illustrative examples of plots comprising simulated and measured H-Plane (e.g., elevational) radiation patterns for a 4.6 GHz Z-meandering antenna configuration, in units of decibels relative to an isotropic radiator (dBi).

FIG. 5A shows illustrative examples of plots comprising simulated and measured H-Plane (e.g., elevational) radiation patterns for a 5 gigahertz (GHz) 2D circular patch antenna, in units of decibels relative to an isotropic radiator (dBi) and FIG. 5B shows illustrative examples of plots comprising simulated and measured H-Plane (e.g., elevational) radiation patterns for a 4.6 GHz Z-meandering antenna configuration, in units of decibels relative to an isotropic radiator (dBi). Measurements of the radiation patterns shown in the illustrative examples of FIG. 5A and FIG. 5B were performed using an ETSLindgren anechoic chamber (constructed by ETS-Lindgren L.P., Cedar Park, Tex., USA), at 5 GHz and 4.6 GHz, for the 2D circular patch antenna and the Z-meandered antenna, respectively. The radiation pattern measurements agree closely with the simulation results for the two fabricated antennas (200A of FIG. 2A and 200B of FIG. 2B). The simulated gain is around 6 dBi for the flat circular patch antenna and about 5.90 dBi for the Z-meandered antenna, which represents a gain drop of only about 0.1 dBi for a decrease of about 8% of the resonance frequency.

Figure 6:
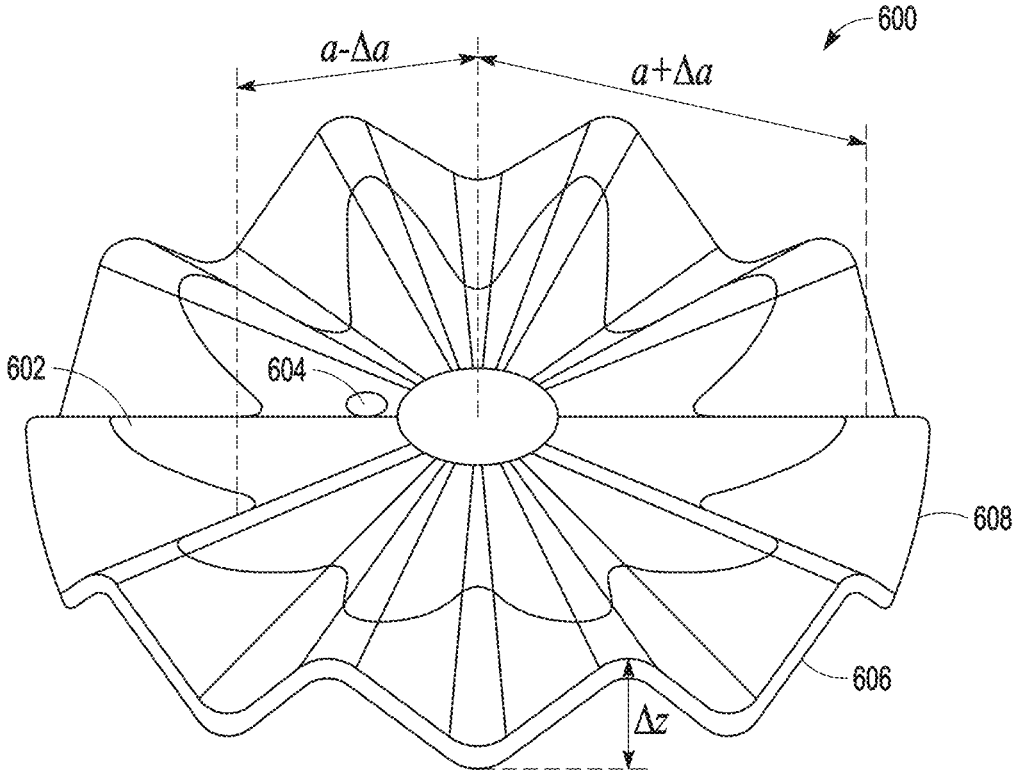
FIG. 6, illustrates yet another illustrative example of a Z-meandering configuration, such as including variation in a conductive patch radius about a central region.

FIG. 6, illustrates yet another illustrative example of a Z-meandering configuration 600, such as including variation in a conductive patch 602 radius about a central region. The configuration 600 of FIG. 6 is similar to FIG. 1B and FIG. 2B, but in the illustrative example of FIG. 6, a Z-axis spatial oscillation of the substrate 608 shape over a range, ΔZ, can be accompanied by spatial oscillation of a radius of the conductive region 602, such as over a range, 2Δa, such that a minimum radius between "petals" of the conductive region 602 can be represented by represented as a−Δa and a maximum radius defining the petals can be represented as a+Δa. Such a configuration 600 can be referred to as an RZ-meandering configuration, because such a configuration includes variation in both the radial direction (by varying the patch radius about the center) and in the Z-direction (out-of-plane, defined by substrate undulation, for example). As in the examples of FIG. 1B and FIG. 2B, a feedpoint 604 can be included to drive the antenna, and a surface 606 opposite the conductive patch 602 can include a reference or ground plane.

Generally, the examples herein are shown having a single conductive layer for the patch structure. Other variations can be used, such as a balanced configuration including two conductive layers on or within an undulating dielectric substrate, such as having bow-tie configuration or other configuration. In another example, a slot antenna can be used such as having a conductive layer defining an aperture.

Figure 7:
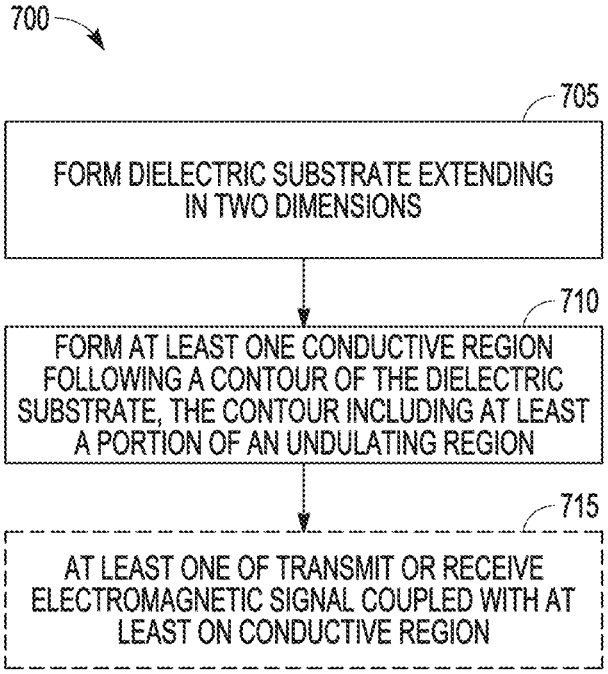
FIG. 7 illustrates generally a technique, such as a method, comprising forming a dielectric substrate and forming at least one conductive region following a contour of the dielectric substrate.

FIG. 7 illustrates generally a technique, such as a method, comprising forming a dielectric substrate and forming at least one conductive region following a contour of the dielectric substrate.

Various Notes

Each of the non-limiting aspects above can stand on its own or can be combined in various permutations or combinations with one or more of the other aspects or other subject matter described in this document.

The above detailed description includes references to the accompanying drawings, which form a part of the detailed description. The drawings show, by way of illustration, specific embodiments in which the invention can be practiced. These embodiments are also referred to generally as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part (e.g., such to facilitate machine-controlled or computer-controlled fabrication, for example). Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A method for fabricating an antenna, the method comprising:

forming a dielectric substrate extending in two dimensions and defining an undulating region extending out of a plane defined by the two dimensions; and forming at least one conductive region following a contour of the dielectric substrate including at least a portion of the undulating region, the at least one conductive region defining a patch structure that varies in radial extent around a circumference of the at least one conductive region relative to a central region.

2. The method of claim 1, wherein the at least one conductive region following the contour of the dielectric substrate comprises a first conductive region on a first layer, and a second conductive region on another layer separate from the first conductive region of the first layer.

3. The method of claim 1, wherein the forming the dielectric substrate includes depositing a dielectric substrate material using fused deposition.

4. The method of claim 1, wherein the forming the dielectric substrate includes at least one of stamping or hot-forming the dielectric substrate.

5. The method of claim 1, wherein the forming the at least one conductive region comprises depositing a conductive ink.

6. The method of claim 1, wherein the forming the at least one conductive region comprises printing a conductive ink.

7. The method of claim 6, wherein printing the conductive ink includes screen-printing the conductive ink.

8. The method of claim 6, wherein printing the conductive ink includes ink-jet printing or aerosol-jet printing the conductive ink.

9. The method of claim 6, wherein printing the conductive ink includes thermally printing the conductive ink.

10. The method of claim 1, wherein the undulating region defines a lateral profile comprising a sinusoid.

11. The method of claim 1, wherein the at least one conductive region oscillates in radial extent around a circumference of the at least one conductive region relative to the central region.

12. The method of claim 2, wherein a surface of the dielectric substrate opposite a location of the first conductive region also defines an undulating region; and wherein the second conductive region follows a contour of the dielectric substrate, the second conductive region including at least a portion following the undulating region of the dielectric substrate on the surface opposite the first conductive region.

13. An antenna comprising a dielectric substrate extending in two dimensions and defining an undulating region extending out of a plane defined by the two dimensions; and at least one conductive region following a contour of the dielectric substrate including at least a portion of the undulating region, the at least one conductive region defining a patch structure that varies in radial extent around a circumference of the at least one conductive region relative to a central region.

14. The antenna of claim 13, wherein the at least one conductive region following the contour of the dielectric substrate comprises a first conductive region on a first layer, and a second conductive region on another layer separate from the first conductive region of the first layer.

15. The antenna of claim 13, wherein the dielectric substrate comprises a material deposited using fused deposition; and wherein the at least one conductive region comprises a cured conductive ink.

16. The antenna of claim 13, wherein the undulating region defines a lateral profile comprising a sinusoid.

17. The antenna of claim 13, wherein the at least one conductive region and dielectric substrate are radially symmetric about the central region.

18. The antenna of claim 13, wherein the at least one conductive region oscillates in radial extent around a circumference of the at least one conductive region relative to the central region.

19. The antenna of claim 14, wherein a surface of the dielectric substrate opposite a location of the first conductive region also defines an undulating region; and wherein the second conductive region follows a contour of the dielectric substrate, the second conductive region including at least a portion following the undulating region of the dielectric substrate on the surface opposite the first conductive region.

20. An antenna fabrication system, comprising:

an additive fabrication means for forming a dielectric substrate, the dielectric substrate extending in two dimensions and defining an undulating region extending out of a plane defined by the two dimensions; and a printing means for forming at least one conductive region following a contour of the dielectric substrate including at least a portion of the undulating region, the at least one conductive region defining a patch structure that varies in radial extent around a circumference of the at least one conductive region relative to a central region.

* * * * *